US008520879B2

(12) United States Patent
Yoshino

(10) Patent No.: US 8,520,879 B2
(45) Date of Patent: Aug. 27, 2013

(54) GOOSENECK CONDENSER MICROPHONE

(75) Inventor: Satoshi Yoshino, Machida (JP)

(73) Assignee: Kabushiki Kaisha Audio-Technica, Machida-Shi (JP)

( * ) Notice: Subject to any disclaimer, the term of this patent is extended or adjusted under 35 U.S.C. 154(b) by 9 days.

(21) Appl. No.: 13/445,606

(22) Filed: Apr. 12, 2012

(65) Prior Publication Data

US 2012/0263334 A1 Oct. 18, 2012

(30) Foreign Application Priority Data

Apr. 14, 2011 (JP) ..... 2011-89910

(51) Int. Cl.
*H04R 25/00* (2006.01)

(52) U.S. Cl.
USPC ..... 381/363; 381/361

(58) Field of Classification Search
USPC ..... 381/361–363, 365–368, 374
See application file for complete search history.

(56) References Cited

U.S. PATENT DOCUMENTS

| | | | | |
|---|---|---|---|---|
| 6,671,382 | B2 * | 12/2003 | Chen | 381/361 |
| 6,711,272 | B2 * | 3/2004 | Rodgers | 381/363 |
| 7,526,097 | B2 * | 4/2009 | Akino | 381/361 |
| 8,150,088 | B2 * | 4/2012 | Akino et al. | 381/363 |

FOREIGN PATENT DOCUMENTS

| | | |
|---|---|---|
| JP | 2006-033216 | 2/2006 |
| JP | 2011-172140 | 9/2011 |

* cited by examiner

*Primary Examiner* — Suhan Ni
(74) *Attorney, Agent, or Firm* — Manabu Kanesaka

(57) ABSTRACT

Provided is an integrated gooseneck condenser microphone including a microphone unit and an output module which are connected to each other. The gooseneck condenser microphone can improve the connection strength of a microphone housing and prevent the generation of noise due to disturbance electromagnetic waves. The gooseneck condenser microphone includes a connection member 20*b* which is provided at the rear end of a shielded housing 20*a* and into which the leading end of a supporting pipe 30 is inserted and an electrical insulating member 6 that is interposed between the connection member and the supporting pipe and electrically insulates the connection member from the supporting pipe. A groove portion 5 is formed in the inner circumferential surface of the connection member along the circumferential direction, and the leading ends of the supporting pipe and the electrical insulating member inserted into the connection member are fitted to the groove portion while the diameters thereof are expanded.

5 Claims, 5 Drawing Sheets

GOOSENECK CONDENSER MICROPHONE

BACKGROUND OF THE INVENTION

1. Field of the Invention

The present invention relates to a gooseneck condenser microphone in which a microphone body is supported by a flexible supporting pipe, and more particularly, to a technique capable of preventing the generation of noise due to electromagnetic waves emitted from, for example, a mobile phone.

2. Description of the Related Art

A gooseneck condenser microphone (hereinafter, simply referred to as a "condenser microphone") has a simple appearance and makes it easy to adjust an angle or a height with respect to the speaker. Therefore, the gooseneck condenser microphone is widely used in, for example, conference facilities, such as international conference halls, or TV studios.

The gooseneck condenser microphones are mainly classified into a separation type in which the microphone unit and the output module are separated from each other and an integrated type in which the microphone unit and the output module are connected to each other.

That is, in a separation-type condenser microphone A illustrated in FIG. 4, a condenser microphone unit (hereinafter, simply referred to as a "microphone unit") 10 is separated from an output module 20 including an audio signal output circuit board 21 for the microphone unit, the microphone unit 10 is supported at the leading end of a supporting pipe 30, and the output module 20 is attached to the rear end (base) of the supporting pipe 30.

The supporting pipe 30 includes a flexible shaft 31. In this example, the flexible shaft 31 includes a front flexible shaft 31*a*, a rear flexible shaft 31*b*, and a relay pipe 32 which is a metal straight pipe and is interposed between the front and rear flexible shafts. The output module 20 includes a shielded housing 20*a* and is provided on a base, such as a table, through a fixing bracket (not illustrated).

The microphone unit 10 and the audio signal output circuit board 21 of the output module 20 are electrically connected to each other by a microphone cable 40 inserted into the supporting pipe 30. A two-core shielded line is used as the microphone cable 40. In the separation type, the audio signal output circuit board 21 and an output connector 22 are provided in the output module 20.

In general, as the output connector 22, an output connector is used which includes a first pin for ground, a second pin which is on the hot side of a signal, and a third pin which is on the cold side, which are specified in EIAJ RC-5236 "Latch Lock Type Round Connector for Audio Equipment".

Although not illustrated in the drawings, the microphone unit 10 includes an FET (field effect transistor) as an impedance converter. In the separation type, the microphone cable 40 is an unbalanced transmission table. In the microphone unit 10, one core of the microphone cable 40 is connected as a power line to the drain of the FET and the other core thereof is connected as a signal line to the source. In addition, the shielded line is connected to a unit case which is the ground. The source of the FET is also connected to the unit case (ground).

In the output module 20, the power supply side of the microphone cable 40 and the signal line are connected to predetermined terminals of the audio signal output circuit board 21 and the shielded line is connected to the ground (ground circuit) of the audio signal output circuit board 21. The ground of the audio signal output circuit board 21 is connected to the first pin of the output connector 22, and the first pin is also connected to the shielded housing 20*a* of the output module 20. That is, the first pin is the base point of ground.

The output connector 22 is connected to a phantom power supply (not illustrated) through a balanced two-core shielded cable. In some cases, the output module 20 is referred to as a power module since it supplies power to the microphone unit 10.

In contrast, an integrated condenser microphone B illustrated in FIG. 5 includes a microphone body M which connects the microphone unit 10 and the output module 20. The microphone body M is supported at the leading end of the supporting pipe 30. A base housing 50 including only the output connector 22 is attached to the rear end of the supporting pipe 30.

In the condenser microphone B, the audio signal output circuit board 21 in the output module 20 and the output connector 22 in the base housing 50 are electrically connected to each other through the microphone cable 40.

In the integrated type, the microphone cable 40 is a balanced transmission cable. In the output module 20, a hot-side signal line and a cold-side signal line of the microphone cable 40 are connected to the drain and source of the FET through predetermined wiring lines of the audio signal output circuit board 21, and a shielded line is connected to the ground of the audio signal output circuit board 21. However, the source of the FET and the ground of the audio signal output circuit board 21 are connected to the shielded housing 20*a* which serves as the ground.

In the base housing 50, the hot-side signal line and the cold-side signal line of the microphone cable 40 are connected to the second and third pins of the output connector 22 and the shielded line is connected to the first pin. The first pin is also connected to the base housing 50. In the condenser microphone B, the first pin is the base point of the ground.

In this example, the supporting pipe 30 includes a flexible shaft 31 which is provided at the rear end and a relay pipe 32. A coupler (connection member) 20*b* made of a metal material is provided at the rear end of the shielded housing 20*a* of the output module 20. The output module 20 is connected to the relay pipe 32 through the coupler 20*b*.

However, in both the separation-type condenser microphone A and the integrated condenser microphone B, the supporting pipe 30 and the shielded line of the microphone cable 40 function as an antenna and are likely to be affected by external noise (disturbance electromagnetic waves).

The flexible shaft 31 includes a steel coil spring and a triangular wire rod which is made of, for example, a copper alloy and is plastically deformed. A contact portion between the wire rods has impedance although the resistance value thereof is small (for example, about 1Ω). Therefore, the microphone cable 40 is not completely shielded from a high frequency.

When a strong disturbance electromagnetic wave is emitted to the microphone cable 40, it is transmitted as a high-frequency current to the microphone unit 10 or the output module 20 and is detected by a semiconductor device, such as an FET. As a result, noise is generated due to the high-frequency current.

In particular, a considerably strong electromagnetic wave (for example, electric field intensity which is tens to thousands of times more than that generated by commercial radio waves in the range of several centimeters to several tens of centimeters) is emitted from the mobile phone. Therefore, in the field of a condenser microphone, there is an urgent need to take measures for electromagnetic waves when the mobile phone is used at a short distance.

For the separation-type condenser microphone A illustrated in FIG. 4, in Japanese Patent Application Laid-Open (JP-A) No. 2006-33216, the present applicant discloses a structure in which the external sheath of at least a portion which is disposed inside a flexible shaft in the microphone cable inserted into a supporting pipe is removed such that a shielded line is exposed and the shielded line is electrically connected to the flexible shaft at multiple points.

According to this structure, it is expected that the resistance value of the flexible shaft will be significantly reduced, a shielding function for electromagnetic waves will be improved, and the generation of noise due to disturbance electromagnetic waves will be effectively prevented.

The invention disclosed in JP-A No. 2006-33216 is a little effective for the integrated condenser microphone B illustrated in FIG. 5. However, in the integrated type, since the distance between the ground (ground circuit) of the audio signal output circuit board 21 in the output module 20 and the ground base point (first pin) of the entire microphone is equal to the length of the supporting pipe 30, a high-frequency current generated due to the disturbance electromagnetic wave is more likely to be mixed than that in the separation type.

In addition, since the supporting pipe 30 is electrically connected to the shielded housing 20*a* of the output module 20, the disturbance electromagnetic wave captured by the supporting pipe 30 is transmitted as a high-frequency current from the shielded housing 20*a* to the output module 20.

In order to solve the above-mentioned problems, the present applicant has provided a gooseneck condenser microphone in which a microphone case (shielded housing) is insulated from a supporting pipe to prevent the mixture of a high-frequency current with an output module (Japanese Patent Application No. 2010-035903).

The structure of a condenser microphone C disclosed in Japanese Patent Application No. 2010-035903 will be described with reference to FIG. 6. In FIG. 6, the same components as those in the integrated condenser microphone illustrated in FIG. 5 are denoted by the same reference numerals.

The condenser microphone C illustrated in FIG. 6 includes a metal cover 60 which is a gold-plated brass member and is provided at the rear end of a shielded housing 20*a* in order to shield the disturbance electromagnetic wave. A core insertion hole 63 is formed in the metal cover 60 and cores 41 and 42 of a microphone cable 40 are inserted into a shielded housing 20*a* through the core insertion hole 63 and are connected to predetermined terminals of an audio signal output circuit board 21 by, for example, soldering. In addition, a shielded line 43 of the microphone cable 40 is connected to the metal cover 60 by, for example, soldering and the metal cover 60 is electrically connected to a ground pattern of the audio signal output circuit board 21. A cylindrical electrical insulating member 80 made of a resin (for example, an ABS resin) is provided between a coupler 20*b* and a relay pipe 32 (supporting pipe 30) such that the coupler 20*b* and the relay pipe 32 are electrically insulated from each other. The coupler 20*b* is inserted into the shielded housing 20*a* and is electrically connected to the shielded housing 20*a*.

According to this structure, a complete shield in which a contact portion between the metal cover 60 and the shielded housing 20*b* is the base point of ground is formed in the output module 20. Therefore, it is possible to prevent the mixture of the disturbance electromagnetic wave captured by the supporting pipe 30.

However, in the structure illustrated in FIG. 6, the relay pipe 21 (supporting pipe 30) is simply inserted into the coupler 20*b* with the electrical insulating member 80 interposed between and the interposed electrical insulating member 80 is made of a resin. Therefore, the electrical insulating member 80 made of a resin is gradually plastically deformed in the thickness direction and the thickness thereof is reduced. As a result, the coupling performance of the connection portion is reduced.

SUMMARY OF THE INVENTION

The invention has been made in view of the above-mentioned problems and an object of the invention is to provide an integrated gooseneck condenser microphone which includes a microphone unit and an output module connected to each other, can improve the connection strength of a microphone housing, and can prevent the generation of noise due to a disturbance electromagnetic wave.

In order to solve the above problems, according to an aspect of the invention, a gooseneck condenser microphone includes: a supporting pipe that is made of a metal material; a microphone body that is supported at a leading end of the supporting pipe; a base housing that includes an output connector therein and is attached to a rear end of the supporting pipe; a connection member; and an electrical insulating member that is interposed between the connection member and the supporting pipe and electrically insulates the connection member from the supporting pipe. The microphone body includes a microphone unit and an output module which includes a shielded housing and an audio signal output circuit for the microphone unit provided in the shielded housing. The microphone unit and the output module are connected to each other. The audio signal output circuit and the output connector are electrically connected to each other through a microphone cable including a two-core shielded line inserted into the supporting pipe. The connection member is provided at the rear end of the shielded housing and the leading end of the supporting pipe is inserted into the connection member. A groove portion is formed in an inner circumferential surface of the connection member along a circumferential direction. The leading ends of the supporting pipe and the electrical insulating member inserted into the connection member are fitted to the groove portion while the diameters thereof are expanded.

According to this structure, it is possible to fixedly connect the microphone body (connection member) and the supporting pipe.

The gooseneck condenser microphone according to the above-mentioned aspect may further include a metal cover that is provided at the leading end of the connection member on the rear end side of the shielded housing, has a core insertion hole formed at the center thereof and a circumferential portion coming into contract with the shielded housing, and is electrically connected to one end of the shielded line of the microphone cable and a ground portion of the audio signal output circuit. Each core of the microphone cable may be inserted into the shielded housing through the core insertion hole and be connected to a predetermined terminal of the audio signal output circuit. The other end of the shielded line may be electrically connected to a ground terminal of the output connector.

In this way, it is possible to form a complete shield in which a contact portion between the metal cover and the shielded housing is a base point of ground in the output module. Therefore, it is possible to prevent the mixture of a disturbance electromagnetic wave captured by the supporting pipe and prevent the generation of noise due to the disturbance electromagnetic wave.

The electrical insulating member may include a cylindrical portion that covers an outer circumferential surface of the supporting pipe inserted into the connection member and an annular flange that is formed inward at the leading end of the cylindrical portion. The annular flange may be locked to a leading end surface of the supporting pipe and cover the end surface.

In this way, the electrical insulating member does not deviate from the supporting pipe and the annular flange covers the end surface of the supporting pipe such that the supporting pipe does not come into contact with the relay member.

An adhesive may be filled into a space of the groove portion into which the leading end of the supporting pipe is inserted.

As such, when the adhesive is filled into the groove portion, it is possible to fixedly connect the microphone body (connection member) and the supporting pipe.

According to the invention, it is possible to achieve an integrated gooseneck condenser microphone which includes a microphone unit and an output module connected to each other, can improve the connection strength of a microphone housing, and can prevent the generation of noise due to a disturbance electromagnetic wave.

DESCRIPTION OF THE PREFERRED EMBODIMENTS

Figure 1:
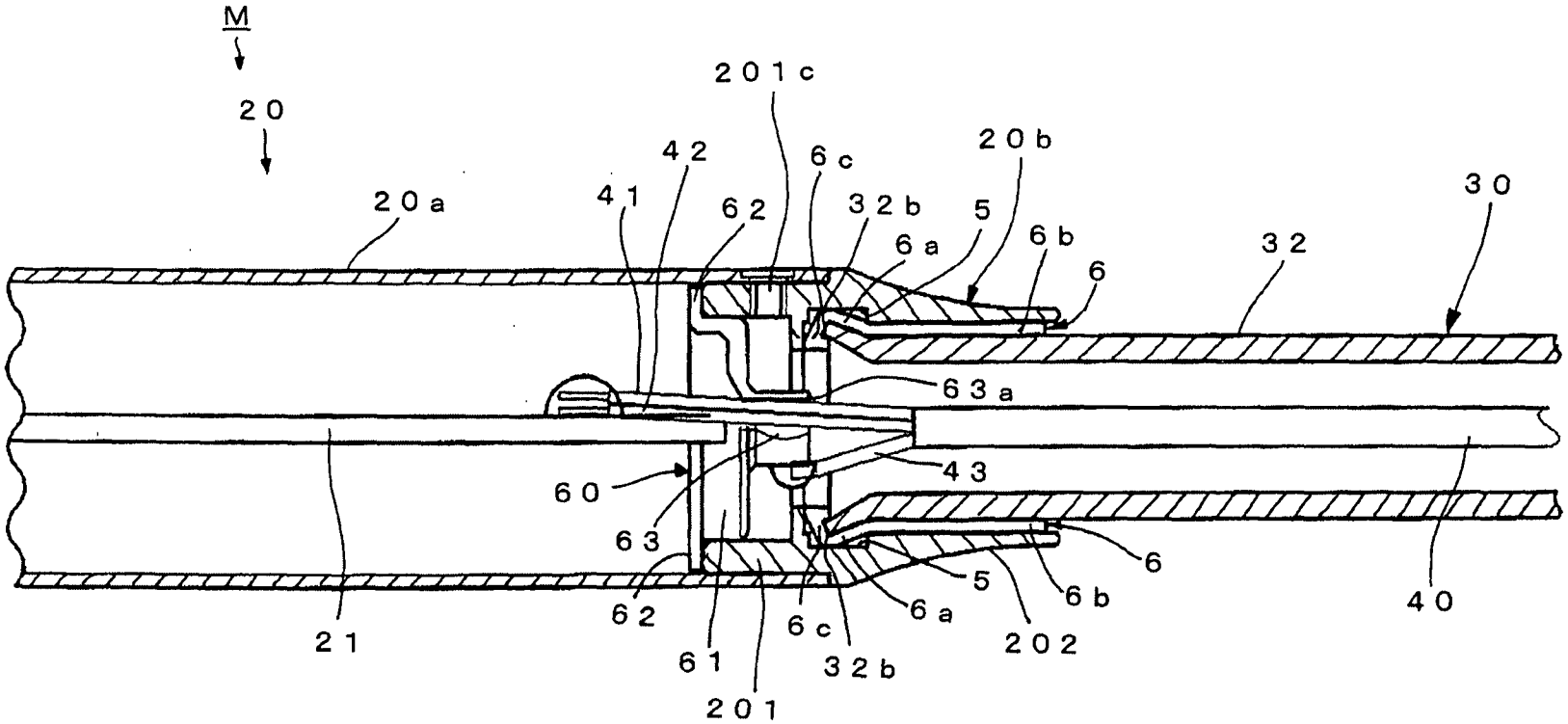
FIG. 1 is an enlarged cross-sectional view illustrating a portion of a gooseneck condenser microphone according to an embodiment of the invention.

Hereinafter, exemplary embodiments of the invention will be described with reference to the accompanying drawings. FIG. 1 is an enlarged cross-sectional view illustrating a portion of a gooseneck condenser microphone according to an embodiment of the invention.

The gooseneck condenser microphone according to the embodiment of the invention is applied to an integrated condenser microphone which has been described above with reference to FIGS. 5 and 6. In FIG. 1, substantially the same or equivalent components as those illustrated in FIGS. 5 and 6 are denoted by the same reference numerals.

Figure 5:
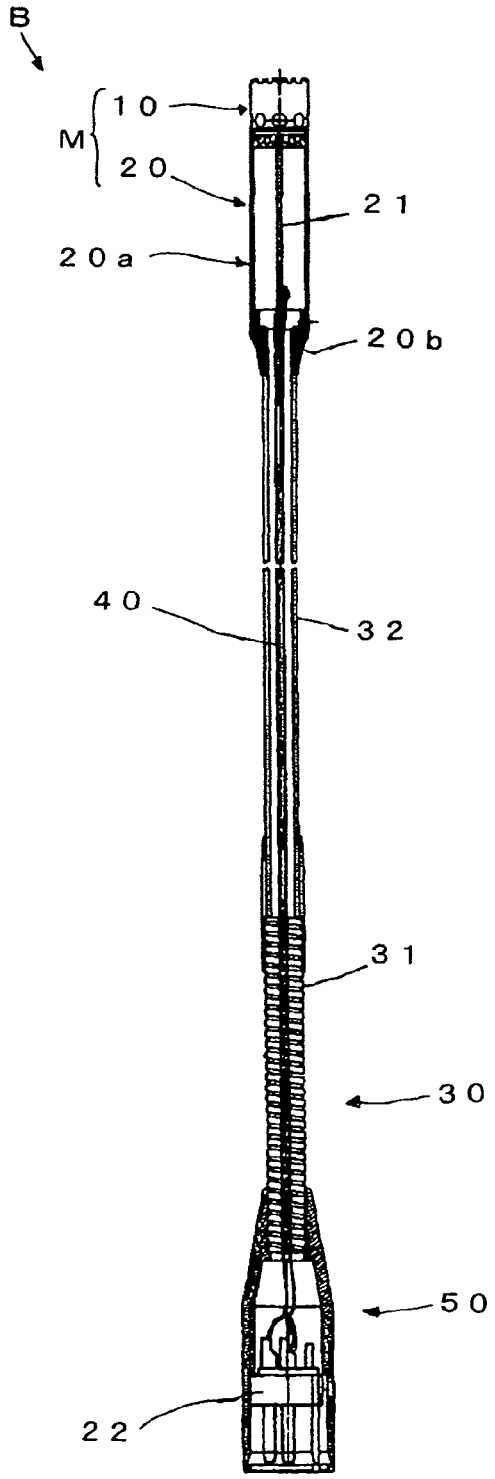
FIG. 5 is a cross-sectional view illustrating the structure of an integrated gooseneck condenser microphone according to the related art.
Figure 6:
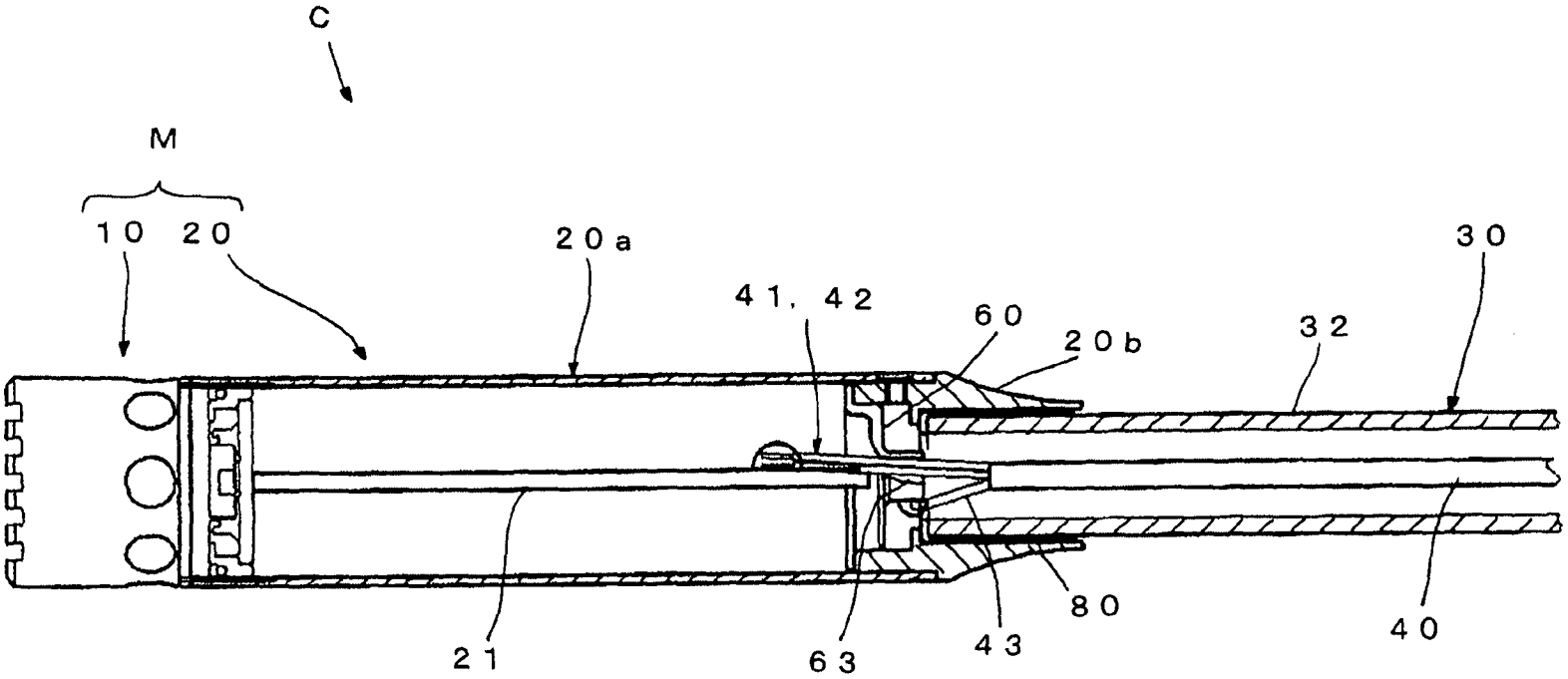
FIG. 6 is a cross-sectional view illustrating the structure of an integrated gooseneck condenser microphone in which an electrical insulating member is interposed between a coupler (connection member) and a relay pipe.

FIG. 1 illustrates the leading end of a shielded housing 20*a* and the rear end of a supporting pipe 30, which have the same structure as those illustrated in FIGS. 5 and 6. That is, a microphone unit 10 (see FIGS. 5 and 6) is provided at the leading end of the shielded housing 20*a*. The microphone unit 10 and an output module 20 form a microphone body M. A base housing 50 including an output connector 22 is integrally attached to the rear end of the supporting pipe 30 (see FIG. 5).

Although not illustrated in the drawings, an acoustoelectric converter in which a diaphragm and a fixed electrode are opposite to each other with a separator interposed therebetween and an FET serving as an impedance converter are provided in the microphone unit 10. It is preferable that the microphone unit 10 be removable from the output module 20.

The output module 20 includes the cylindrical shielded housing 20*a* made of, for example, brass. The shielded housing 20*a* includes an audio signal output circuit board 21 which performs predetermined processing on an audio signal from the microphone unit 10 and outputs the audio signal. Although not illustrated in the drawings, for example, an amplifying circuit, a filter circuit, and a ground pattern (ground circuit) are formed on the audio signal output circuit board 21.

A coupler (connection member) 20*b* for attaching the output module 20 to the supporting pipe 30 is provided at the rear end of the shielded housing 20*a*. The coupler 20*b* is a cylinder made of, for example, brass and includes a fixing portion 201 which is fitted and fixed to the shielded housing 20*a* (screw hole 201*c*) and a connection cylinder 202 into which a relay pipe 32 of the supporting pipe 30 is inserted.

As described above, the relay pipe 32 made of a metal material (for example, aluminum) is inserted into the connection cylinder 202 of the coupler 20*b* and an electrical insulating member 6 which has a substantially cylindrical shape and is made of, for example, an ABS resin is interposed between the connection cylinder 202 and the relay pipe 32 such that the connection cylinder 202 is electrically insulated from the relay pipe 32.

As illustrated in the drawings, an annular fitting groove 5 (groove portion) is provided in the inner circumferential surface of the coupler 20*b* in the circumferential direction, and the leading end 6*a* of the electrical insulating member 6 and the leading end 32*a* of the relay pipe 32 are fitted to the fitting groove 5 while the diameters thereof are expanded. In this way, the coupler 20*b* and the relay pipe 32 are fixedly connected to each other.

The electrical insulating member 6 includes a cylindrical portion 6*b* which can cover the relay pipe 32 and an annular flange 6*c* which is formed inward at the leading end of the cylindrical portion 6*b*. The annular flange 6*c* is locked to an end surface 32*b* of the relay pipe 32. Therefore, the electrical insulating member 6 does not deviate from the relay pipe 32 and the annular flange 6*c* covers the end surface 32*b* of the relay pipe 32 such that the relay pipe 32 does not contact the coupler 20*b*.

Figure 2:
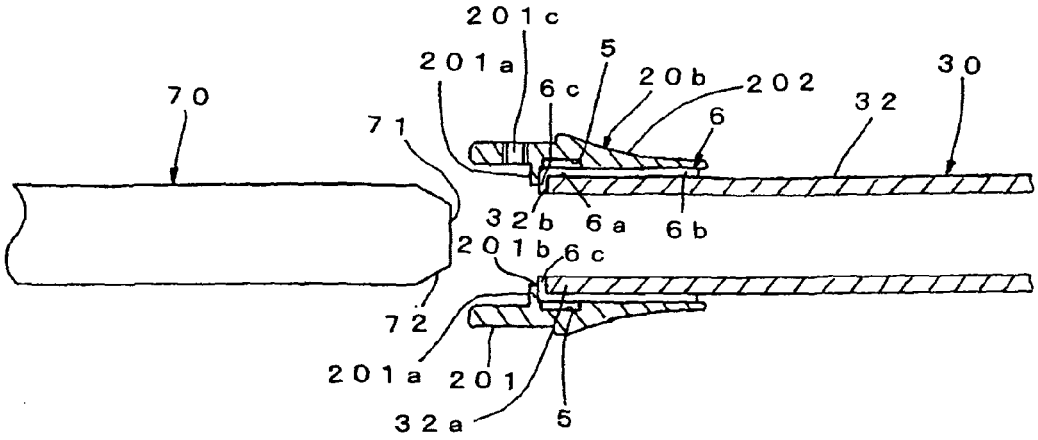
FIG. 2 is a cross-sectional view illustrating a process of connecting a coupler and a relay pipe in the gooseneck condenser microphone according to the embodiment of the invention before the diameter of the leading end of the relay pipe is expanded.

However, as described above, when the coupler 20*b* and the relay pipe 32 are connected to each other, first, the leading end 32*a* of the relay pipe 32 is inserted into the coupler 20*b* from the rear end side, with the leading end 32*a* of the relay pipe 32 covered with the electrical insulating member 6, as illustrated in FIG. 2.

In this case, the end surface 32*b* of the relay pipe 32 is locked to the annular flange 6*c* of the electrical insulating member 6 and the annular flange 6*c* of the electrical insulating member 6 is locked to an annular flange 201*a* which is provided on the inner circumferential surface of the fixing portion 201. In this way, the components are positioned. However, as illustrated in FIG. 2, the fitting groove 5 is provided on the rear side (side close to the connection cylinder 202) of the annular flange 201*a*.

Since the diameter of the leading end 6*a* of the electrical insulating member 6 and the diameter of the leading end 32*a* of the relay pipe 32 are expanded, a wedge-shaped jig 70 having a leading end with a truncated conical shape is inserted into the relay pipe 32 from the side of the leading end 32*a*.

As illustrated in FIG. 2, the diameter of the wedge-shaped jig 70 is substantially equal to that of an opening portion 201*b* which is formed by the annular flange 201*a* of the fixing portion 201 in the coupler 20*b* such that the wedge-shaped jig 70 can be inserted into the opening portion 201*b*. In addition, the diameter of a leading end surface 71 of the wedge-shaped jig 70 is less than the inside diameter of the relay pipe 32. When the leading end of the wedge-shaped jig 70 is inserted into the relay pipe 32, the inner circumferential surface of the leading end 32*a* of the relay pipe 32 comes into contact with a tapered surface 72 of the wedge-shaped jig 70. However, it is preferable that the taper angle of the tapered surface 72 be about 30 degrees with respect to the axis of the wedge-shaped jig 70.

Figure 3:
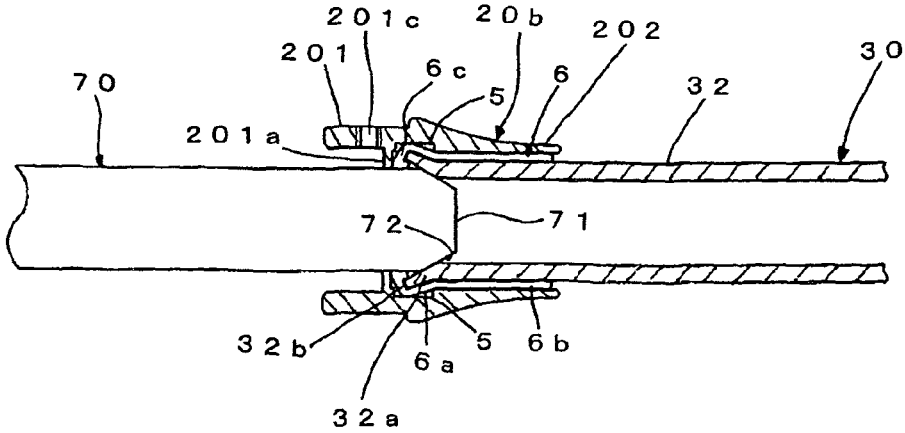
FIG. 3 is a cross-sectional view illustrating the process of connecting the coupler and the relay pipe in the gooseneck condenser microphone according to the embodiment of the invention after the diameter of the leading end of the relay pipe is expanded.
Figure 4:
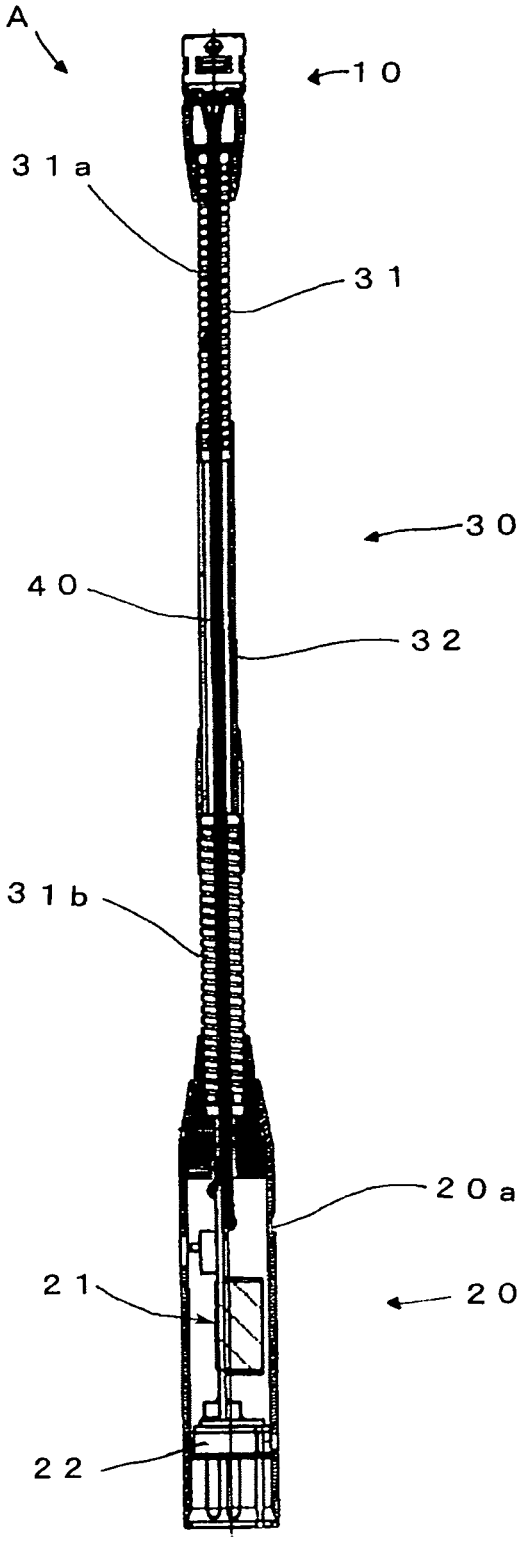
FIG. 4 is a cross-sectional view illustrating the structure of a separation-type gooseneck condenser microphone according to the related art.

As illustrated in FIG. 2, when the leading end of the wedge-shaped jig 70 formed in this way is inserted into the relay pipe 32 from the side of the leading end 32*a* and is then pressed, the leading end 32*a* (inner circumferential surface side) of the relay pipe 32 comes into contact with the tapered surface 72 of the wedge-shaped jig 70 and a pressing force from the tapered surface 72, that is, an external force in the diametric direction is applied to the leading end 32*a*. In this way, as illustrated in FIG. 3, the diameter of the leading end 32*a* of the relay pipe 32 and the diameter of the leading end 6*a* of the electrical insulating member 6 are expanded and the leading end 32*a* of the relay pipe 32 and the leading end 6*a* of the electrical insulating member 6 are fitted to the locking groove 5.

Then, the wedge-shaped jig 70 is taken out from the relay pipe 32. In this way, as illustrated in FIG. 1, the leading end 32*a* of the relay pipe 32 can be fitted and connected to the coupler 20*b*.

However, it is preferable that an adhesive be filled into the fitting groove 5 in advance before the relay pipe 32 is inserted into the coupler 20*b* from the rear end side and the diameter of the leading end 32*a* is expanded. That is, in this way, when the leading end 32*a* of the relay pipe 32 and the leading end 6*a* of the electrical insulating member 6 are fitted to the fitting groove 5 while the diameters thereof are expanded, a space of the fitting groove 5 is filled with the adhesive. Therefore, it is possible to fixedly connect the relay pipe 32 and the coupler 20*b*.

A metal cover 60 which is preferably a gold-plated brass member is provided at the rear end of the shielded housing 20*a* in order to shield disturbance electromagnetic waves.

In this embodiment, the metal cover 60 includes a cylindrical portion 61 which is fitted to the fixing portion 201 of the coupler 20*b*. A flange 62 with which the end surface of the fixing portion 201 and the inner surface of the shielded housing 20*a* are contacted is integrally formed in the circumference of the cylindrical portion 61.

It is preferable that the outside diameter of the flange 62 be slightly more than the inside diameter of the shielded housing 20*a* in order to bring the flange 62 into close contact with the inner surface of the shielded housing 20*a*, that is, in order to reliably electrically connect the flange 62 to the shielded housing 20*a*.

In addition, a core insertion hole 63 into which each core (a power line 41 and a signal line 42) of a microphone cable 40 are inserted is provided at the center of the metal cover 60. In this embodiment, preferably, a sleeve 63*a* which can be plastically deformed is integrally formed around the core insertion hole 63.

One end of each of a hot-side signal line 41 and a cold-side signal line 42 of the microphone cable 40 is inserted into the shielded housing 20*a* through the core insertion hole 63 of the metal cover 60 and is connected to a predetermined terminal of the audio signal output circuit board 21 by, for example, soldering. One end of a shielded line 43 is connected to the metal cover 60 by, for example, soldering.

The other ends of the hot-side signal line 41 and the cold-side signal line 42 of the microphone cable 40 are connected to second and third pins of the output connector 22, respectively, and the other end of the shielded line 43 is connected to a first pin of the output connector 22.

The ground pattern (ground circuit) of the audio signal output circuit board 21 is also electrically connected to the metal cover 60. The ground pattern may be connected to the metal cover 60 by a wiring material. In addition, the ground pattern may be directly connected to the metal cover 60 by, for example, soldering, without a wiring material interposed therebetween.

As such, the metal cover 60 is arranged on the rear end side of the shielded housing 20*a* of the output module 20 so as to come into contact with the shielded housing 20*a*, the shielded line of the microphone cable 40 and the ground pattern of the audio signal output circuit board 21 are electrically connected to the metal cover 60, and the shielded housing 20*a* and the supporting pipe 30 are electrically insulated from each other. In this way, it is possible to provide a complete shield in which a contact portion between the metal cover 60 and the shielded housing 20*a* is the base point of ground to the output module 20.

As described above, according to the embodiment of the invention, the annular fitting groove 5 is formed in the inner circumferential surface of the coupler 20*b* which is provided at the rear end of the shielded housing 20*a* in the circumferential direction. The leading end 32*a* of the supporting pipe 30 (relay pipe 32) and the leading end 6*a* of the electrical insulating member 6 which are inserted into the coupler 20*b* are fitted to the fitting groove 5 while the diameters thereof are expanded.

In this way, it is possible to fixedly connect the microphone body M (coupler 20*b*) and the supporting pipe 30 (relay pipe 32).

As described above, since a complete shield in which the contact portion between the metal cover 60 and the shielded housing 20*a* is the base point of ground can be formed in the output module 20, it is possible to prevent the mixture of disturbance electromagnetic waves through the supporting pipe 30 and prevent the generation of noise due to the disturbance electromagnetic waves.

What is claimed is:

1. A gooseneck condenser microphone comprising:

a supporting pipe that is made of a metal material;

a microphone body that is supported at a leading end of the supporting pipe;

a base housing that includes an output connector therein and is attached to a rear end of the supporting pipe;

a connection member; and an electrical insulating member that is interposed between the connection member and the supporting pipe and electrically insulates the connection member from the supporting pipe, wherein the microphone body includes a microphone unit and an output module which includes a shielded housing and an audio signal output circuit for the microphone unit provided in the shielded housing, the microphone unit and the output module are connected to each other, the audio signal output circuit and the output connector are electrically connected to each other through a microphone cable including a two-core shielded line inserted into the supporting pipe, the connection member is provided at the rear end of the shielded housing and the leading end of the supporting pipe is inserted into the connection member, a groove portion is formed in an inner circumferential surface of the connection member along a circumferential direction, and the leading ends of the supporting pipe and the electrical insulating member inserted into the connection member are fitted to the groove portion while the diameters thereof are expanded.

2. The gooseneck condenser microphone according to claim 1, further comprising:

a metal cover that is provided at the leading end of the connection member on the rear end side of the shielded housing, has a core insertion hole formed at the center thereof and a circumferential portion coming into contract with the shielded housing, and is electrically connected to one end of the shielded line of the microphone cable and a ground portion of the audio signal output circuit, wherein each core of the microphone cable is inserted into the shielded housing through the core insertion hole and is connected to a predetermined terminal of the audio signal output circuit, and the other end of the shielded line is electrically connected to a ground terminal of the output connector.

3. The gooseneck condenser microphone according to claim 2, wherein the electrical insulating member includes a cylindrical portion that covers an outer circumferential surface of the supporting pipe inserted into the connection member and an annular flange that is formed inward at the leading end of the cylindrical portion, and the annular flange is locked to a leading end surface of the supporting pipe and covers the end surface.

4. The gooseneck condenser microphone according to claim 1, wherein the electrical insulating member includes a cylindrical portion that covers an outer circumferential surface of the supporting pipe inserted into the connection member and an annular flange that is formed inward at the leading end of the cylindrical portion, and the annular flange is locked to a leading end surface of the supporting pipe and covers the end surface.

5. The gooseneck condenser microphone according to any one of claims 1 to 3, wherein an adhesive is filled into a space of the groove portion into which the leading end of the supporting pipe is inserted.

* * * * *